United States Patent [19]

Iwai

[11] Patent Number: 4,737,206

[45] Date of Patent: Apr. 12, 1988

[54] EXTRUDED ALUMINUM ALLOYS HAVING IMPROVED WEAR RESISTANCE AND PROCESS FOR PREPARING SAME

[75] Inventor: Ichiro Iwai, Tochigi, Japan

[73] Assignee: Showa Aluminum Kabushiki Kaisha, Osaka, Japan

[21] Appl. No.: 894,470

[22] Filed: Aug. 4, 1986

Related U.S. Application Data

[63] Continuation of Ser. No. 645,842, Aug. 29, 1984, abandoned.

[30] Foreign Application Priority Data

| | | | |
|---|---|---|---|
| Sep. 7, 1983 | [JP] | Japan | 58-165799 |
| Mar. 16, 1984 | [JP] | Japan | 59-52004 |
| Mar. 16, 1984 | [JP] | Japan | 59-52005 |
| Mar. 16, 1984 | [JP] | Japan | 59-52006 |

[51] Int. Cl.[4] ..... C22C 21/02

[52] U.S. Cl. ..... 148/438; 72/377; 148/2; 148/11.5 A; 148/439

[58] Field of Search ..... 148/2, 3, 11.5 A, 438, 148/439; 72/377

[56] References Cited

U.S. PATENT DOCUMENTS 4,077,810 3/1978 Ohuchi et al. ..... 148/3

*Primary Examiner*—R. Dean

*Attorney, Agent, or Firm*—Collard, Roe & Galgano

[57] ABSTRACT

An extruded aluminum alloy improved especially in wear resistance and cuttability and comprising 12 to 30% of Si and 0.3 to 7.0% of Cu, with or without 0.3 to 2.0% of Mg, the balance being substantially aluminum. In this alloy, primary Si crystals 40 to 80 microns in particle size occupy at least 60% of the area occupied by all the primary Si crystals in the aluminum matrix, and eutectic Si crystals up to 10 microns in particle size occupy at least 60% of the area occupied by all the eutectic Si crystals in the matrix. The primary and eutectic Si crystals are uniformly dispersed throughout the matrix. A process for preparing the extruded aluminum alloy is also disclosed.

28 Claims, No Drawings

EXTRUDED ALUMINUM ALLOYS HAVING IMPROVED WEAR RESISTANCE AND PROCESS FOR PREPARING SAME

This application is a continuation of application Ser. No. 645,842 filed Aug. 29, 1984, abandoned.

BACKGROUND OF THE INVENTION

The present invention relates to aluminum alloys prepared by extrusion, and more particularly to extruded Al-Si-Cu alloys and Al-Si-Cu-Mg alloys having a high silicon content and excellent in wear resistance and cuttability.

Throughout the specification and appended claims, the percentages used for the alloy components are all by weight.

Aluminum alloys having high strength, especially high wear resistance, are very useful for various mechanical parts which are subjected to great frictional forces, such as connecting rods of motor vehicle engines, power transmission pulleys, slippers, vanes and pistons of compressors, cylinder linings for engines, tape guides for tape recorders, synchronizer rings for speed change gears, etc., because the aluminum alloy is more lightweight than any other wear-resistant metal and therefore has various advantages.

A4032 alloy containing 11.0 to 13.5% of Si is already known as a wrought aluminum alloy having outstanding high-temperature characteristics. Although characterized by high resistance to heat and wear and a small coefficient of expansion, this wrought alloy is originally intended for forging and does not exhibit such characteristics before being forged. Thus the alloy material itself does not exhibit the above characteristics, while it is not noticeably excellent in cuttability. Accordingly the alloy has found greatly limited use only, for example, for pistons and cylinder heads.

Conventionally cast aluminum alloys are generally used for applications where especially high wear resistance is essentially required. Well known as such wear-resistant cast aluminum alloys are Al-Si alloys which contain about 10 to about 24% of Si and which include, for example, JIS-AC3A, -AC8A-C, -AC9A-B, etc. However, these alloys, which are cast, are limited in the shape of product, and it is difficult to obtain products of desired shape unlike wrought alloys. Accordingly they have the drawback of being limited in use. Moreover, because these alloy materials are prepared by casting, the primary Si crystals and eutectic Si crystals which are contained therein and serve as chief components for giving improved wear resistance are relatively coarse, have irregular shapes and are distributed unevenly. For example, the primary Si crystals are generally coarse and include those as large as about 150 microns in particle size, which the eutectic Si crystals are acicular and include those which are about 30 microns in length. These crystals are present as unevenly distributed. Because of these drawbacks, the cast alloys are not fully satisfactory in wear resistance or cutting properties. Although the particle size of primary Si crystals can be slightly reduced by an improvement treatment, the reduced sizes obtainable are limited to about 100 microns, while it is impossible to improve the eutectic Si crystals. Above all, it is impossible to correct the uneven distribution, so that the wear resistance of the alloy inevitably varies greatly from portion to portion.

In view of the above problems, research has been conducted extensively to obtain fine primary and eutectic Si crystals. As a result, Published Examined Japanese Patent Application No. 53-20242, for example, proposes to rapidly cool the molten alloy to be cast at a very high rate of 50° C./sec to thereby inhibit the growth of crystals and give primary and eutectic Si crystals of greatly reduced sizes. It is reported that this prior-art method affords primary Si crystals of up to 40 microns in size if largest and eutectic Si crystals a majority of which are up to 20 microns in length. The specification of U.S. Pat. No. 4,077,810 also discloses a similar technique based on the same concept as above.

Nevertheless, my research has revealed that the greatest possible size reduction of Si particles, especially primary Si crystals, in the alloy structure does not always result in a proportional improvement in the wear resistance of the alloy. While the wear resistance of the alloy is provided by Si crystals which individually withstand the surface pressure resulting from friction, many experiments I have conducted show that the Si particles in the aluminum matrix, if excessively fine, rather exhibit reduced ability to withstand the frictional surface pressure, consequently failing to give improved wear resistance as contemplated.

Accordingly I have made investigations into particle size distributions of primary Si crystals and eutectic Si crystals which contribute to the greatest possible extent to the improvement of wear resistance and found such distributions to accomplish the present invention.

SUMMARY OF THE INVENTION

As will be apparent from the foregoing description, a first object of the present invention is to provide an aluminum alloy material which is excellent chiefly in wear resistance and also in mechanical cuttability, and more particularly an extruded high-silicon aluminum alloy which contains Si in a hypereutectic region and which is made to have very high wear resistance, good cuttability and excellent workability by controlling the components and structure of the alloy.

A second object of the invention is to provide a process for preparing a high-silicon aluminum alloy wherein primary Si crystals and eutectic Si crystals are controlled to give the above-mentioned desirable properties.

According to a feature of the present invention which fulfills these objects, there is provided an extruded aluminum alloy having high wear resistance and excellent cuttability and comprising 12 to 30% of Si and 0.3 to 7.0% of Cu, with or without 0.3 to 2.0% of Mg, the balance being aluminum and inevitable impurities, the alloy having a structure wherein primary Si crystals ranging from 40 to 80 microns in particle size occupy at least 60% of the area occupied by all primary Si crystals in the aluminum matrix and eutectic Si crystals up to 10 microns in particle size occupy at least 60% of the area occupied by all eutectic Si crystals in the aluminum matrix, the primary and eutectic Si crystals being uniformly dispersed throughout the alloy structure.

According to another feature of the present invention, there is provided a process for preparing an extruded aluminum alloy having the foregoing characteristics by casting a specified high-silicon aluminum alloy composition into a billet first and extruding the billet under specific conditions. It has generally been thought extremely difficult and unsuited to extrude high-silicon aluminum alloys because these alloys per se are highly resistant to deformation. Further when such an alloy is to be extruded, it has been thought necessary to reduce the extruding speed and to elevate the extruding temperature to the highest possible level in order to enhance the fluidity of the alloy. However, when the alloy is extruded under such conventional conditions, it is impossible to control the primary and eutectic Si crystals in the aluminum alloy to the foregoing desirable state, while the product obtained is in no way suited to use because of marked surface cracks, surface roughness and other defects.

Accordingly the present invention presents optimum conditions for extruding the alloy billet in order to obtain a high-silicon aluminum alloy material which is outstanding in wear resistance and cuttability. Quite contrary to the conventional general concept, the extrusion conditions include a low extruding temperature and a high extruding speed. More specifically, the invention provides a process for preparing a wear-resistant extruded aluminum alloy from a high-silicon aluminum alloy composition containing Si in a hypereutectic region, i.e. from a composition comprising 12 to 30% of Si and 0.3 to 7.0% of Cu, with or without 0.3 to 2.0% of Mg, the balance being aluminum and inevitable impurities, the process consisting essentially of the steps of casting the composition into a billet and extruding the billet under the conditions of:

| | |
|---|---|
| Temperature of billet: | 350–420° C. |
| Speed of extruding ram: | 0.03–0.2 m/min. |
| Extrusion ratio: | 10–40. |

Other objects and advantages of the present invention will become more apparent from the following detailed description.

DETAILED DESCRIPTION OF THE INVENTION

The extruded aluminum alloy of the present invention is outstanding in wear resistance and cuttability and contains Si in a hypereutectic region. Preferably, the alloy comprises, for example, 12 to 30% of Si and 0.3 to 7.0% of Cu, with or without 0.3 to 2.0% of Mg, the balance being aluminum and inevitable impurities.

The contents of the alloy components are limited as above for the following reasons.

As is well known, Si is effective for giving improved wear resistance. If the Si content is less than 16%, the resulting wear resistance intended by the invention is not achieved. If the Si content is in excess of 30%, the alloy is difficult to cast. The present invention is directed to high-silicon aluminum alloys containing Si in a hypereutectic region. While the eutectic point of aluminum-silicon alloys is 11.7% silicon, the eutectic point changes when the alloy contains a third element. The alloy of the present invention must contain Si in a hypereutectic range of at least 12%. Most suitably, the Si content is in the range of about 18 to about 20%.

Cu and Mg are effective for giving improved strength to the alloy, but if the contents of these elements are less than 0.3%, the effect achieved is insufficinet. However, when the Cu content exceeds 7%, seriously impaired wear resistance will result. Further when the Mg content exceeds 2%, the above effect will not increase noticeably but coarse crystals will be formed to impair the mechanical properties of the alloy. Experimental results indicate that most preferably, the Cu content should be about 3 to about 6%, and the Mg content should be about 0.45 to about 0.65%.

The alloy of the invention may contain Sr and/or P as optionally preferred additive element(s). These elements are effective for rendering primary Si crystals finer when the aluminum alloy is melted and cast into billets. Sr and P are equivalent in respect of this function, so that at least one of them may be incorporated into the alloy. However, if the Sr and P contents are less than 0.005% singly or as combined together, the above effect will not be available to a full extent, whereas even if they are above 0.1%, a noticeably enhanced effect will not be achieved. Accordingly, Sr and/or P should be contained in an amount of 0.005 to 0.1%, preferably about 0.01 to about 0.06%.

The alloy of the invention may further contain one or at least two of Sn, Pb and Bi in an amount of 0.1 to 1.0% singly or as combined together. These elements are effective for giving improved cuttability to the alloy and are equivalent in this function. Accordingly good results are obtained when 0.1 to 1.0% of at least one of these elements is present. If the content of the element or the combined amount of such elements is less than 0.1%, the cutting properties will not be improved satisfactorily, whereas if the content or combined amount exceeds 1.0%, cracks develop in the billet obtained by casting. Most preferably, the content or amount is about 0.4 to about 0.6%.

The alloy of the present invention may further contain one or at least two of Ni, Fe and Mn as other optional significant additives, in an amount of 0.5 to 3.0% singly or as combined together. These elements, which are useful for giving improved heat resistance, will not be fully effective if present in an amount of less than 0.5% singly or as combined together, whereas if the amount exceeds 3%, seriously impaired cuttability will result.

The extruded alloy of the invention having the above composition is prepared by casting and subsequent extrusion so as to have a specifically controlled structure. First, a mixture having the same composition as above is melted and cast into a billet by the usual method. The primary Si crystals contained in the resulting billet are reduced in size to some extent owing to the presence of Sr and/or P but are generally still large and include those as large as 100 microns. Further the eutectic Si crystals are generally considerably large and include those having particle sizes of about 30 microns and are acicular.

Accordingly the billet containing these relatively coarse primary and eutectic Si crystals is extruded hot at about 350° to about 420° C. The hot extrusion process breaks some coarse primary Si crystals in the alloy, with the result that almost all primary Si crystals therein are in the range of 10 to 80 microns in size. Thus the primary Si crystals are so sized that those not smaller than 40 microns in size occupy at least 60% of the area occupied by all primary Si crystals. The acicular eutectic Si particles in the alloy are divided longitudinally thereof into particles, such that almost all particles are up to 15 microns in size. Thus the eutectic Si crystals are so reduced in size that the particles up to 10 microns in size occupy at least 60% of the area occupied by all eutectic Si crystals. The primary and eutectic Si crystals are uniformly distributed through the alloy structure. The term "almost all" used above means that the alloy may contain particles other than the above-mentioned size ranges, but when preferred extrusion conditions are used, the alloy can be made virtually free from primary and eutectic Si crystals which are outside the specified size ranges.

The primary Si crystals ranging from 40 to 80 microns in particle size are so limited as to have an area ratio of at least 60% in the alloy structure as stated above, because if the primary crystals less than 40 microns are present in a large proportion, the alloy fails to exhibit high wear resistance as contemplated, whereas when containing a large amount of primary particles larger than 80 microns, the alloy has an uneven distribution of coarse particles, exhibiting greatly varying wear resistance and impaired cuttability. Further the limitation that almost all eutectic Si crystals are up to 15 microns in size and that those up to 10 microns have an area ratio of at least 60% invariably results from the above limitation on the size of the primary Si crystals. The limitation on the eutectic Si crystals will be effective for giving improved cuttability because otherwise, i.e. if eutective Si particles larger than 15 microns are present in a large proportion, at least reduced cuttability would result.

To obtain an alloy of the composition thus controlled, the billet is extruded under the following conditions: temperature of billet, 350°–420° C.; speed of extruding ram, 0.03–0.2 m/min; and extrusion ratio, 10–40. Further preferably, the extruding die has a bearing length of 5 to 15 mm.

These extruding conditions have the following technical significance.

If the billet temperature is below 350° C., the billet is difficult to extrude because of excessive resistance to deformation, whereas at temperatures higher than 420° C., cracks develop in the surface of the extrusion to render the surface defective. The most preferred billet temperature ranges from 380° to 400° C.

While the ram speed is variable in accordance with the extrusion ratio or speed, primary and eutectic Si crystals of desired fine sizes will not be obtained effectively at a speed lower than 0.03 m/min. Conversely, speeds higher than 0.2 m/min entail marked cracking in the extruded product. Most suitably, the rma speed is about 0.05 to about 0.15 m/min.

At an extrusion ratio of less than 10, the billet will not be extruded effectively, failing to afford an alloy of improved structure, whereas at an extrusion ratio of more than 40, the billet will not be extrudable smoothly partly because of increased resistance of alloy to deformation. The preferred extrusion ratio ranges from about 20 to about 30 generally.

On the other hand, the shape of the die to be used for extrusion greatly influences the acceptability of the extruded product obtained. Although dies usually used for extruding wrought aluminum alloys are about 3 mm in bearing length, such a die tends to produce marked surface cracks in the product, failing to give a product of good quality when used for high-silicon aluminum alloys such as the one contemplated by the present invention. Accordingly it is suitable to use a die having a bearing length of at least 5 mm. However, when the bearing length is larger than 15 mm, the die has no particular advantage but merely has the disadvantage of giving increased resistance to extrusion. Thus, the die to be used is 5 to 15 mm, most preferably 6 to 12 mm, in bearing length.

The process of the invention described affords an extruded aluminum alloy which is superior in wear resistance, cuttability and workability to known wear-resistant wrought alloys such as JIS-A4032 and also to the aforementioned wear-resistant cast alloys and which is reduced in variations of wear resistance. Moreover because the present alloy is prepared by extrusion, the alloy can be easily made into shapes which are difficult to form with cast alloys. Unlike castings, the extruded alloy is extendable and therefore has higher workability and malleability, hence various advantages.

Examples of the invention are given below.

EXAMPLE 1

For the preparation of alloys Nos. 1 to 6, each composition listed in Table 1 below was cast into billets, 120 mm in diameter, by the usual semicontinuous casting process, and the billets were extruded into a round bar, 30 mm in diameter, at a temperature of 415° C. and extruding ram speed of 0.1 m/min. The extruding die was 10 mm in bearing length.

TABLE 1

| Alloy No. | Al-base alloy composition (%) | | | | | |
|---|---|---|---|---|---|---|
| | Si | Cu | Mg | Sr | P | Al |
| 1 | 18 | 5 | 0.5 | 0.02 | — | Balance |
| 2 | 20 | 4 | 1 | 0.03 | — | Balance |
| 3 | 20 | 4 | — | — | 0.02 | Balance |
| 4 | 16 | 6 | 0.6 | — | 0.02 | Balance |
| 5 | 25 | 2 | 0.5 | — | 0.03 | Balance |
| 6 | 15 | 4 | 0.5 | 0.04 | — | Balance |
| 7 | 15 | 4 | 1.8 | — | — | Balance |
| 8 | 12 | 1.1 | 1.0 | — | — | Balance |

Extruded aluminum alloys prepared according to the invention (alloy Nos. 1 to 6) were checked for composition. All the primary Si crystals in each alloy were found to be in the range of 10 to 80 microns in size. Of these, crystals ranging from 40 to 80 microns occupied at least 60% of the area occupied by all primary Si crystals. The eutectic Si crystals, which were found to have been finely divided, were all up to 15 microns in size if largest, and those up to 10 microns occupied at least 60% of the area occupied by all eutectic Si crystals.

Alloy No. 7 listed in Table 1 was prepared by casting the listed composition according to the prior-art process disclosed in Published Examined Japanese Patent Application No. 53-20242 at a cooling rate of 90° C./sec and thereafter subjecting the casting to $T_6$ treatment (510° C.×5 hr., hardening with hot water at 80° C., followed by tempering at 170° C. for 10 hours).

Almost all primary Si crystals contained in the alloy casting thus obtained (comparative alloy or comp. alloy No. 7) were very fine particles of up to 40 microns in size.

Alloy No. 8 was known AC8A alloy. Test pieces were prepared from a commercial product of this alloy (comparative alloy or comp. alloy No. 8).

Alloys Nos. 1 to 8 were tested for wear resistance and cuttability. Alloys Nos. 1 and 4 were also checked for these properties as cast. Table 2 shows the results.

The test piece was checked for wear resistance with use of an Ohkoshi abrasion tester including a rotary disk under the conditions of: friction distance 600 m, friction speed 2 m/sec and rubbing material (rotary body) FC-30 (JIS). The wear resistance is expressed in terms of specifc wear amount of the test piece measured.

The cuttability was checked in terms of the life of cutting tool which is an important factor in evaluating the cuttability. For this purpose, a cutting tool of cemented carbide was used which had the specifications of: front rake angle 0 degree, side rake angle 10 degrees, front relief angle 7 degrees, side relief angle 7 degrees, front cuttng edge angle 8 degrees, side cutting edge angle 0 degree, and nose radius 0 degree. The test piece was cut under the following conditions: cutting depth 0.1 mm, feed speed 0.05 mm, speed of rotation 500 r.p.m., lubricant petroleum, and cutting distance 200 m. The width of the resulting wear on the relief face of the tool was measured.

TABLE 2

| Test piece | Alloy No. | Wear resistance Specific wear amount ($\times 10^{-6}$ mm$^2$/kg) | Cutting tool life Width of tool wear (μm) |
|---|---|---|---|
| Alloy of invention | 1 | 0.9–1.1 | 34 |
| | 2 | 0.9–1.0 | 35 |
| | 3 | 1.0–1.1 | 35 |
| | 4 | 1.1–1.2 | 33 |
| | 5 | 0.6–0.7 | 36 |
| Cast alloy | 1 | 1.0–1.9 | 110 |
| | 4 | 1.2–1.8 | 130 |
| Comp. alloy | 6 | 1.3–1.4 | 30 |
| | 7 | 1.7–1.8 | 30 |
| | 8 | 1.8–1.9 | 25 |

Throughout Table 1 and 2, like alloys are referred to by like reference numbers.

The results of wear resistance test given in Table 2 show that the aluminum alloys of the invention are apparently higher in wear resistance and smaller in variations in this resistance than the castings and have remarkably higher wear resistance than the comparative alloys. Further with respect to cutting tool life, the alloys of the invention are greatly improved over those tested as cast and are comparable or superior to the comparative alloys.

EXAMPLE 2

Table 3 shows the alloy compositions used.

TABLE 3

| Alloy No. | Al-base alloy composition (%) | | | | | | |
|---|---|---|---|---|---|---|---|
| | Si | Cu | Mg | Sn | Pb | Bi | Al |
| 9 | 15 | 3 | 0.5 | 0.4 | — | — | Balance |
| 10 | 16 | 6 | 1 | — | 0.4 | 0.2 | Balance |
| 11 | 18 | 5 | 0.5 | — | 0.5 | — | Balance |
| 12 | 20 | 4 | 1 | 0.6 | — | — | Balance |
| 13 | 20 | 4 | — | — | 0.5 | — | Balance |
| 14 | 25 | 3 | 0.5 | — | — | 0.5 | Balance |
| 15 | 25 | 4 | 1 | 0.5 | — | — | Balance |
| 16 | 15 | 2 | 0.5 | — | — | — | Balance |
| 17 | 20 | 2 | 0.5 | — | — | — | Balance |
| 18 | 25 | 2 | 0.5 | — | — | — | Balance |

Each alloy composition listed was cast into billets, 120 mm in diameter, by the semicontinuous casting process (with addition of 0.03% of Sr to form finely divided primary Si during casting). The primary Si crystals contained in the billet were generally 10 to 100 microns in size, while the eutectic Si crystals therein were acicular and included those as large as 30 microns in size.

The billets of various compositions thus produced were treated by soaking, then extruded into round bars, 30 mm in diameter, under the conditions of: billet temperature 400° C., extruding ram speed 0.1 m/min and extrusion ratio 16, and subjected to $T_6$ treatment to obtain test peces.

The test pieces were checked for structure. The primary Si crystals contained in each of alloys Nos. 9 to 18 were all in the size range of 10 to 80 microns, and those ranging from 40 to 80 microns apparently occupied at least 60% of the area occupied by all primary Si crystals. The eutectic Si crystals were found to have been finely divided and were all up to 10 microns in size if largest. Of these, those up to 10 microns had an area ratio of at least 60%.

The test pieces were tested for wear resistance and cuttability in the same manner as in Example 1. Table 4 shows the results.

TABLE 4

| Test piece | Alloy No. | Wear resistance Specific wear amount ($\times 10^{-6}$ mm$^2$/kg) | Cutting tool life Width of tool wear (μm) |
|---|---|---|---|
| Alloy of the invention | 10 | 1.1–1.2 | 26 |
| | 11 | 0.9–1.1 | 29 |
| | 12 | 0.9–1.0 | 30 |
| | 13 | 1.0–1.1 | 30 |
| | 14 | 0.6–0.7 | 32 |
| | 15 | 0.6–0.8 | 32 |
| | 17 | 0.9–1.0 | 35 |
| | 18 | 0.6–0.8 | 36 |
| comp. alloy | 9 | 1.3–1.4 | 27 |
| | 16 | 1.3–1.4 | 30. |

Table 4 reveals that all alloys Nos. 9 to 18 have high wear resistance. However, alloys Nos. 9 to 15 containing at least one of Sn, Pb and Bi are smaller in the amount of wear on the cutting tool than alloys Nos. 16 to 18 which are free from such elements. This indicates that the addition of these elements apparently gives improved cuttability.

EXAMPLE 3

Table 5 shows the alloy compositions used.

TABLE 5

| Alloy No. | Al-base alloy composition (%) | | | | | | | | |
|---|---|---|---|---|---|---|---|---|---|
| | Si | Cu | Mg | Mn | Fe | Ni | Sr | P | Al |
| 19 | 20 | 2 | 0.5 | — | — | — | 0.02 | — | Balance |
| 20 | 20 | 4 | 1 | — | — | 1.5 | 0.03 | — | Balance |
| 21 | 20 | 4 | — | — | — | 1.5 | — | 0.02 | Balance |
| 22 | 25 | 2 | 1 | — | 1.5 | — | — | 0.02 | Balance |
| 23 | 25 | 2 | 0.5 | — | 2 | — | — | 0.03 | Balance |
| 24 | 15 | 4 | 0.5 | 0.5 | 0.5 | 2.5 | 0.04 | — | Balance |

Each composition listed was semicontinuously cast into billets, 120 mm in diameter, which were then extruded into an aluminum alloy round bar, 30 mm in diameter, under the conditions of: extruding temperature 420° C. and extruding ram speed 0.04 m/min.

The extruded aluminum alloys thus prepared were checked for wear resistance and cuttability. For comparison, alloys Nos. 19 and 22 were also checked for these properties as cast. Table 6 shows the results.

TABLE 6

| Test piece | Alloy No. | Wear resistance Specific wear amount ($\times 10^{-6}$ mm$^2$/kg) | Cutting tool life Width of tool wear (μm) |
|---|---|---|---|
| Alloy of invention | 19 | 0.8 | 38 |
| | 20 | 0.9 | 36 |
| | 21 | 1.0 | 36 |
| | 22 | 0.6 | 40 |
| | 23 | 1.2 | 35 |
| Cast alloy | 19 | 0.8–1.8 | 110 |
| | 22 | 0.7–1.3 | 130 |
| comp. alloy | 24 | 1.4 | 30. |

The results given in Table 6 indicate that the extruded aluminum alloys of the invention are useful for greatly reducing the wear on the relief face of the cutting tool, assuring the tool of a greatly extended life. A comparison between the results of Table 6 and those of Example 1 shown in Table 2 reveals that the alloy of the invention retains high wear resistance and cuttability almost without any deterioration even when containing at least one of Mn, Fe and Ni which are elements for giving improved heat resistance to alloys.

EXAMPLE 4

Billets, 120 mm in diameter, were prepared by semi-continuous casting from an aluminum alloy composition comprising 18% of Si, 4.5% of Cu, 0.5% of Mg and 0.04% of Sr, the balance being aluminum and inevitable impurities. The primary Si crystals contained in the billets as cast were generally in the size range of 10 to 100 microns, and the eutectic Si crystals therein were acicular and generally up to 30 microns in size.

The billets were homogenized at 495° C. for 8 hours, then cooled at room temperature in the atmosphere and thereafter extruded into round bars, 30 mm in diameter, under varying conditions as listed in Table 7.

TABLE 7

| Alloy | | Billet temp. (°C.) | Ram speed (m/min) | Extrusion ratio | Die hearing length (mm) |
|---|---|---|---|---|---|
| Alloy of invention | A | 380 | 0.1 | 20 | 6 |
| | B | 400 | 0.1 | 20 | 9 |
| | C | 420 | 0.15 | 20 | 12 |
| | D | 390 | 0.07 | 30 | 5 |
| | E | 360 | 0.1 | 30 | 7 |
| | F | 390 | 0.1 | 30 | 10 |
| Comparative alloy | G | 480 | 0.1 | 20 | 5 |
| | H | 450 | 0.01 | 30 | 5 |
| | I | 420 | 0.25 | 10 | 3 |
| | J | 410 | 0.02 | 20 | 3 |

When test pieces prepared from alloys A to F were checked for structure, the primary Si crystals in each alloy were in the size range of 10 to 80 microns, and those rang from 49 to 80 microns in size occupied at least 60% of the area occupied by all primary Si crystals. The eutectic Si crystals were found to have been finely divided, and were all up to 15 microns in size. Those up to 10 microns occupied at least 60% of the area occupied by all eutectic Si crystals.

When tested for wear resistance in the same manner as above, alloys A to F were $0.9\text{–}1.1\times10^{-6}$ mm²/kg in specific wear amount.

Comparative alloys G to J were markedly rough-surfaced or had surface cracks and were in no way usable because the billet temperature was excessively high or the extruding speed was too low or high. More specifically, comparative alloys G and I had cracks, while comparative alloys H and J were markedly rough-surfaced, so that the comparative alloys were all unsuited to use.

What is claimed is:

1. An extruded aluminum alloy having excellent wear resistance consisting essentially of 16 to 30% of Si and 0.3 to 7.0% of Cu, the balance being substantially aluminum, the alloy having a structure containing primary and eutectic silicon crystals, with primary Si crystals having a particle size of 40 to 80 microns occupying at least 60% of the area occupied by all primary Si crystals in the aluminum matrix, and eutectic Si crystals having a particle size of up to 10 microns occupying at least 60% of the area occupied by all eutectic Si crystals in the aluminum matrix, the primary and eutectic Si crystals being uniformly dispersed throughout the alloy structure.

2. An extruded aluminum alloy as defined in claim 1 wherein the Si content is 18 to 20%.

3. An extruded aluminum alloy as defined in claim 1 wherein the Cu content is 3 to 6%.

4. An extruded aluminum alloy having excellent wear resistance consisting essentially of 16 to 30% of Si, 0.3 to 7.0% of Cu and 0.3 to 2.0% of Mg, the balance being substantially aluminum, the alloy having a structure containing primary and eutectic silicon crystals, with primary Si crystals having a particle size of 40 to 80 microns occupying at least 60% of the area occupied by all primary Si crystals in the aluminum matrix, and eutectic Si crystals having a particle size of up to 10 microns occupying at least 60% of the area occupied by all eutectic Si crystals in the aluminum matrix, the primary and eutectic Si crystals being uniformly dispersed throughout the alloy structure.

5. An extruded aluminum alloy as defined in claim 4 wherein the Mg content is 0.45 to 0.65%.

6. An extruded aluminum alloy as defined in claim 1 which contains 0.005 to 0.1% of an element selected from the group consisting of P, Sr, and a combination thereof.

7. An extruded aluminum alloy as defined in claim 1 which further contains 0.5 to 3.0% of an element selected from the group consisting of Ni, Fe, Mn, and a combination thereof.

8. An extruded aluminum alloy as defined in claim 1 which further contains 0.1 to 1.0% of an element selected from the group consisting of Sn, Pb, Bi, and a combination thereof.

9. A process for preparing an extruded aluminum alloy having high wear resistance comprising the steps of:

(a) casting into a billet a composition consisting essentially of 16 to 30% of Si and 0.3 to 7.0% of Cu, the balance being substantially aluminum, and (b) hot working the billet by extruding to form an alloy structure containing primary and eutectic silicon crystals with primary Si crystals having a particle size of 40 to 80 microns occupying at least 60% of the area occupied by all primary Si crystals in the aluminum matrix, and eutectic Si crystals having a particle size of up to 10 microns occupying at least 60% of the area occupied by all eutectic Si crystals in the aluminum matrix, the primary and eutectic Si crystals being uniformly dispersed throughout the alloy structure.

10. A process as defined in claim 9 wherein the billet is extruded under the conditions of:

| | |
|---|---|
| (a) billet temperature: | 350–420° C. |
| (b) speed of extruding ram: | 0.03–0.2 m/min. |
| (c) extrusion ratio: | 10–40. |

11. A process as defined in claim 9 wherein the composition comprises 18 to 20% of Si.

12. A process as defined in claim 9 wherein the composition comprises 3 to 6% of Cu.

13. A process as defined in claim 9 wherein the billet is extruded with a die having a bearing length of 5 to 15 mm.

14. A process for preparing an extruded aluminum alloy having high wear resistance comprising the steps of:

(a) casting into a billet a composition consisting essentially of 16 to 30% of Si, 0.3 to 7.0% of Cu, and 0.3 to 2.0% of Mg, the balance being substantially aluminum, and (b) hot working the billet by extruding to form an alloy structure containing primary and eutectic silicon crystals with primary Si crystals having a particle size of 40 to 80 microns occupying at least 60% of the area occupied by all primary Si crystals in the aluminum matrix, and eutectic Si crystals having a particle size of up to 10 microns occupying at least 60% of the area occupied by all eutectic Si crystals in the aluminum matrix, the primary and eutectic Si crystals being uniformly dispersed throughout the alloy structure.

15. A process as defined in claim 14 wherein the billet is extruded under the conditions of:

| | |
|---|---|
| (a) billet temperature: | 350–420° C. |
| (b) speed of extruding ram: | 0.03–0.2 m/min. |
| (c) extrusion ratio: | 10–40. |

16. A process as defined in claim 14 wherein the composition comprises 18 to 20% of Si.

17. A process as defined in claim 14 wherein the composition comprises 3 to 6% of Cu.

18. A process as defined in claim 14 wherein the composition comprises 0.45 to 0.65% of Mg.

19. A process as defined in claim 14 wherein the billet is extruded with a die having a bearing length of 5 to 15 mm.

20. A process as defined in claim 9, wherein the composition further contains 0.005 to 0.1% of an element selected from the group consisting of P, Sr, and a combination thereof.

21. A process as defined in claim 9, wherein the composition further contains 0.5 to 3.0% of an element selected from the group consisting of Ni, Fe, Mn, and a combination thereof.

22. A process as defined in claim 9, wherein the composition further contains 0.1 to 1.0% of an element selected from the group consisting of Sn, Pb, Bi, and a combination thereof.

23. An extruded aluminum alloy as defined in claim 4 which contains 0.005 to 0.1% of an element selected from the group consisting of P, Sr, and a combination thereof.

24. An extruded aluminum alloy as defined in claim 4 which further contains 0.5 to 3.0% of an element selected from the group consisting of Ni, Fe, Mn, and a combination thereof.

25. An extruded aluminum alloy as defined in claim 4 which is further contains 0.1 to 1.0% of an element selected from the group consisting of Sn, Pb, Bi, and a combination thereof.

26. A process as defined in claim 14 wherein the composition further contains 0.005 to 0.1% of an element selected from the group consisting of P, Sr, and a combination thereof.

27. An extruded aluminum alloy as defined in claim 14 which is further contains 0.5 to 3.0% of an element selected from the group consisting of Ni, Fe, Mn, and a combination thereof.

28. A process as defined in claim 14 wherein the composition further contains 0.1 to 1.0% of an element selected from the group consisting of Sn, Pb, Bi, and a combination thereof.

* * * * *